US012383036B2

(12) United States Patent
Mao et al.

(10) Patent No.: US 12,383,036 B2
(45) Date of Patent: Aug. 12, 2025

(54) LIFTING DEVICE AND SHADING DEVICE FOR SUNSHADES

(71) Applicant: HANGZHOU XIAOYI INNOVATIONS TECHNOLOGY CO., LTD., Hangzhou (CN)

(72) Inventors: Ruohan Mao, Hangzhou (CN); Wenjie Zhang, Hangzhou (CN); Rongzhe Liang, Hangzhou (CN); Yunwen Kong, Hangzhou (CN)

(73) Assignee: Ningbo Esoul digital Technology Co., LTD., Ningbo (CN)

( * ) Notice: Subject to any disclaimer, the term of this patent is extended or adjusted under 35 U.S.C. 154(b) by 246 days.

(21) Appl. No.: 18/333,107

(22) Filed: Jun. 12, 2023

(65) Prior Publication Data

US 2024/0090632 A1 Mar. 21, 2024

Related U.S. Application Data

(63) Continuation of application No. PCT/CN2023/095894, filed on May 23, 2023.

(30) Foreign Application Priority Data

Sep. 21, 2022 (CN) ..... 202222509510.4

(51) Int. Cl.
*A45B 25/14* (2006.01)
*A45B 23/00* (2006.01)

(52) U.S. Cl.
CPC ..... *A45B 25/143* (2013.01); *A45B 23/00* (2013.01); *A45B 2023/0012* (2013.01)

(58) Field of Classification Search
CPC ..... A45B 23/00; A45B 25/143; A45B 2023/0012
See application file for complete search history.

(56) References Cited

U.S. PATENT DOCUMENTS 2,960,094 A * 11/1960 Small ..... A45B 25/14 135/37
3,129,715 A * 4/1964 Militano ..... A45B 25/14 403/100

(Continued)

FOREIGN PATENT DOCUMENTS

CN 206212804 U 6/2017
CN 107432534 A 12/2017
CN 210680373 U 6/2020

*Primary Examiner* — Noah Chandler Hawk
(74) *Attorney, Agent, or Firm* — Nitin Kaushik

(57) ABSTRACT

The present utility model provides a lifting device and shading device for a sunshade, which comprises a mounting bracket, a sunshade cloth, a support mechanism and a lifting device set on the mounting bracket, wherein the support mechanism comprises a fixed support member arranged at the top of the mounting bracket, a movable support member sliding on the mounting bracket, and a support component connected to the fixed support member and the movable support member respectively and used for unfolding or closing the sunshade cloth, and the lifting device comprises a driving motor, a transmission mechanism connected to the driving motor and used to drive the lifting motion of the movable support member relative to the mounting bracket, and a control component used to control the start and stop of the driving motor.

7 Claims, 5 Drawing Sheets

(56) References Cited

U.S. PATENT DOCUMENTS

| | | | | |
|---|---|---|---|---|
| 4,424,824 | A * | 1/1984 | Becher | A45B 19/04 135/20.3 |
| 4,807,655 | A * | 2/1989 | Robertson | A45B 23/00 135/22 |
| 4,928,718 | A * | 5/1990 | Apple | A45B 25/16 135/22 |
| 6,170,497 | B1 * | 1/2001 | Ma | A45B 25/14 135/15.1 |
| 8,087,420 | B1 * | 1/2012 | Lukacsy | A45B 25/16 135/22 |
| 11,317,688 | B2 * | 5/2022 | Wang | A45B 23/00 |
| 2005/0247332 | A1 * | 11/2005 | Hung | A45B 25/165 135/20.3 |
| 2016/0360842 | A1 * | 12/2016 | Hsieh | A45B 25/143 |

* cited by examiner

LIFTING DEVICE AND SHADING DEVICE FOR SUNSHADES

CROSS-REFERENCE TO RELATED APPLICATIONS

The application claims priority to Chinese patent application No. 2022225095104, filed on Sep. 21, 2022, the entire contents of which are incorporated herein by reference.

TECHNICAL FIELD

The present utility model belongs to the field of sunshade technology, more specifically, relates to a lifting device and shading device for sunshades.

BACKGROUND

As the social and economic levels rise, the number of people using their free time for outdoor activities is gradually increasing. As a result, sunshades have emerged on the market for outdoor shading and rain protection for users. Sunshades have gradually become an essential shading product for courtyard entertainment, sports, and leisure at home and abroad. In order to provide better shading effect for users, the sunshade will try to increase the area of the sunshade cloth, thereby increasing its shading area. However, it will result in a larger overall volume, heavier weight, and higher umbrella rod, which will cause inconvenience to users in actual use.

In the existing technology, for the convenience of users, a joystick mechanism is generally added to the umbrella rod for opening or closing the sunshade. Users manually rotate the joystick to drive the rotation of the winding shaft to loosen the umbrella rope wrapped on the winding shaft or wrap the umbrella rope around the winding shaft, thereby controlling the lifting or lowering of the umbrella frame and opening or closing the sunshade; However, this method is relatively labor-intensive for users in actual use, and it is easy to cause injuries due to the user's body being touched by the umbrella frame during operation. Users need to squat under the sunshade to operate and constantly observe the position of the umbrella frame, which causes inconvenience for users.

SUMMARY

The purpose of the present utility model is to provide a lifting device for sunshades, in order to solve the technical problems existing in the prior art that users have difficulty using sunshades and are prone to being injured by umbrella frames during use, which causes inconvenience to users.

To achieve the above objective, the technical solution adopted by the present utility model is to provide a lifting device for a sunshade, wherein the sunshade comprises a mounting frame, a sunshade cloth, a support mechanism and a lifting device set on the mounting frame, wherein the support mechanism comprises a fixed support member arranged at the top of the mounting frame, and a movable support member sliding on the mounting frame, and a support component connected to the fixed support member and the movable support member respectively and used for unfolding or closing the sunshade cloth, characterized in that, the lifting device comprises a driving motor, a transmission mechanism connected to the driving motor and used to drive the lifting motor of the movable support member relative to the mounting bracket, and a control component used to control the start and stop of the driving motor.

In one embodiment, the transmission mechanism comprises a winding shaft fixedly connected to the driving motor, a transmission component for driving the lifting motion of the movable support member relative to the mounting bracket, and a main wire wound on the winding shaft for connecting the transmission component.

In one embodiment, the transmission component comprises a sub wire and a pulley set on the mounting bracket and above the movable support member, wherein one end of the sub wire is connected to the main wire, and the other end bypasses the pulley and is connected to the movable support member.

In one embodiment, the number of transmission components is multiple, and the multiple transmission components are uniformly distributed along the circumference of the movable support member, and the transmission mechanism further comprises a splitter for connecting the main wire and the sub wire, and the splitter is provided with a through hole for the main wire and the sub wire to penetrate, the end of the main wire and the end of the sub wire are both equipped with wiring sleeves that are connected to the splitter.

In one embodiment, the transmission mechanism further comprises a buffer component arranged between the wiring sleeve and the splitter, wherein the buffer component comprises a support plate that is connected to the wiring sleeve and an elastic element arranged between the splitter and the support plate.

In one embodiment, the lifting device further comprises an upper limiter and a lower limiter set on the mounting bracket and electrically connected to the driving motor, used to limit the sliding range of the movable support member on the mounting bracket.

In one embodiment, the upper limiter and/or the lower limiter are limit protrusions on the mounting bracket and used to limit the movement of the movable support member, and the driving motor is equipped with an overload monitoring module.

In one embodiment, the upper limiter and/or the lower limiter are position sensors.

In one embodiment, the control component comprises a control housing, a battery detachably connected to the control housing, and a function key set on the control housing and electrically connected to the driving motor.

The beneficial effect of the lifting device provided by the present utility model for sunshades is that, compared with the prior art, the lifting device of the present utility model is used for sunshades, which comprises a mounting frame, a sunshade cloth, a support mechanism, and a lifting device set on the mounting frame. The support mechanism comprises a fixed support member set on the top of the mounting frame and a movable support member sliding on the mounting frame, and support components that are respectively connected to fixed and movable support members and used for unfolding or closing the sunshade cloth. The sunshade is firmly supported on the ground through the mounting frame, the sunshade cloth is fixedly connected to the support components, and the support components are respectively connected to the fixed support component set at the top of the mounting frame and the movable support component sliding on the mounting frame, and the movable support member is used to lift and move relative to the mounting frame, to realize the control of the unfolding or closing of the sunshade cloth; The lifting device comprises a driving motor, a transmission mechanism connected to the driving motor and used to drive the lifting motion of the movable support member relative to the mounting frame, and a control component used to control the start and stop of the driving motor. The driving motor and the movable support member are connected through the transmission mechanism to achieve the lifting motion of the movable support member relative to the mounting frame using the driving motor, thereby controlling the unfolding or closing of the sunshade cloth; Users can start and stop the driving motor by operating the control component, so as to drive the movable support member to lift and lower relative to the mounting frame, and thus control the unfolding or closing of the sunshade cloth. The use of driving method by the driving motor instead of manual driving can save labor and effectively prevent users from being injured by the sunshade during use, providing convenience for users and improving their experience.

The purpose of the present utility model is to provide a shading device for sunshades, in order to solve the technical problems existing in the prior art that users have difficulty using sunshades and are prone to being injured by umbrella frames during use, which causes inconvenience to users.

To achieve the above objective, the technical solution adopted by the present utility model is to provide a shading device, comprising a mounting frame, sunshade cloth, support mechanism, and a lifting device set on the mounting frame; The support mechanism comprises a fixed support member arranged at the top of the mounting frame, a movable support member sliding on the mounting frame, and a support component connected to the fixed support member and the movable support member respectively for unfolding or closing the sunshade cloth.

In one embodiment, the supporting component comprises a main support rod fixedly connected to the sunshade cloth, an auxiliary support rod fixedly connected to the movable support member, and a connecting bracket which is arranged at the end of the auxiliary support rod far from the movable support member, and the connecting bracket is slidably connected to the main support rod.

The beneficial effect of the shading device provided by the present utility model is that, compared with the prior art, the shading device of the present utility model comprises a mounting frame, a sunshade cloth, a support mechanism, and the lifting device set on the mounting frame. The support mechanism comprises a fixed support member set on the top of the mounting frame and a movable support member sliding on the mounting frame, and support components that are respectively connected to fixed and movable support members and used for unfolding or closing the sunshade cloth. The shading device is firmly supported on the ground through the mounting frame, the sunshade cloth is fixedly connected to the support components, and the support components are respectively connected to the fixed support component set at the top of the mounting frame and the movable support component sliding on the mounting frame, and the movable support member is used to lift and move relative to the mounting frame, to realize the control of the unfolding or closing of the sunshade cloth; The lifting device comprises a driving motor, a transmission mechanism connected to the driving motor and used to drive the lifting motion of the movable support member relative to the mounting frame, and a control component used to control the start and stop of the driving motor. The driving motor and the movable support member are connected through the transmission mechanism to achieve the lifting motion of the movable support member relative to the mounting frame using the driving motor, thereby controlling the unfolding or closing of the sunshade cloth; Users can start and stop the driving motor by operating the control component, so as to drive the movable support member to lift and lower relative to the mounting frame, and thus control the unfolding or closing of the sunshade cloth. The use of driving method by the driving motor instead of manual driving can save labor and effectively prevent users from being injured by the shading device during use, providing convenience for users and improving their experience.

BRIEF DESCRIPTION OF DRAWINGS

To more clearly illustrate the technical solutions in the embodiments of the present utility model, a brief description of the drawings required to be used in the embodiments or in the description of the prior art is presented below. It is obvious that the drawings described below are merely embodiments of present utility model, and that other drawings may be obtained from them without any creative effort on the part of the ordinary technician in the field.

Wherein, each of the accompanying markings in Figures are:

1. Mounting frame; 11. Upper limiter; 12. Lower limiter; 2. Support mechanism; 21. Fixed support member; 22. Movable support member; 23. Support components; 231. Main support rod; 232. Auxiliary support rod; 233. Connecting bracket; 3. Lifting device; 31. Driving motor; 32. Transmission mechanism; 321. Winding shaft; 322. Main wire; 323. Transmission components; 3231. Sub wire; 3232. Pulley; 324. Splitter; 325. Wiring sleeve; 326. Buffer component; 3261. Support plate; 3262. Elastic element; 33. Control component; 331. Control housing; 332. Function key; 333. Battery.

DETAILED DESCRIPTION OF THE EMBODIMENTS

In order to make the technical problems, technical solutions and beneficial effects to be solved by present utility model more clearly understood, the following is a further detailed description of the present utility model in conjunction with the accompanying drawings and implementation examples. It should be understood that the specific embodiments described herein are only intended to explain the present utility model and are not intended to limit it.

It should be noted that when a component is referred to as "fixed to" or "set on" another component, it may be directly or indirectly on that other component. When a component is referred to as "connected to" another component, it may be directly connected to another component or indirectly connected to that other component.

It should be understood that the terms "length", "width", "up", "down", "front", "back", "left", "right", "vertical", "horizontal", "top", "bottom", "inside", "outside", etc. indicate an orientation or position relationship based on the orientation or position relationship shown in the attached drawings, which are intended only to facilitate and simplify the description of the present utility model, not to indicate or imply that the device or component referred to must have a particular orientation, be constructed and operated in a particular orientation, and therefore cannot be construed as a limitation on the present utility model.

In addition, the terms "first" and "second" are used for descriptive purposes only and are not to be construed as indicating or implying relative importance or implicitly specifying the quantity of technical features indicated. Thus, the features qualified with "first" and "second" may explicitly or implicitly include one or more of these features. In the description of the present utility model, "multiple" refers to two or more, unless otherwise specified.

Figure 1:
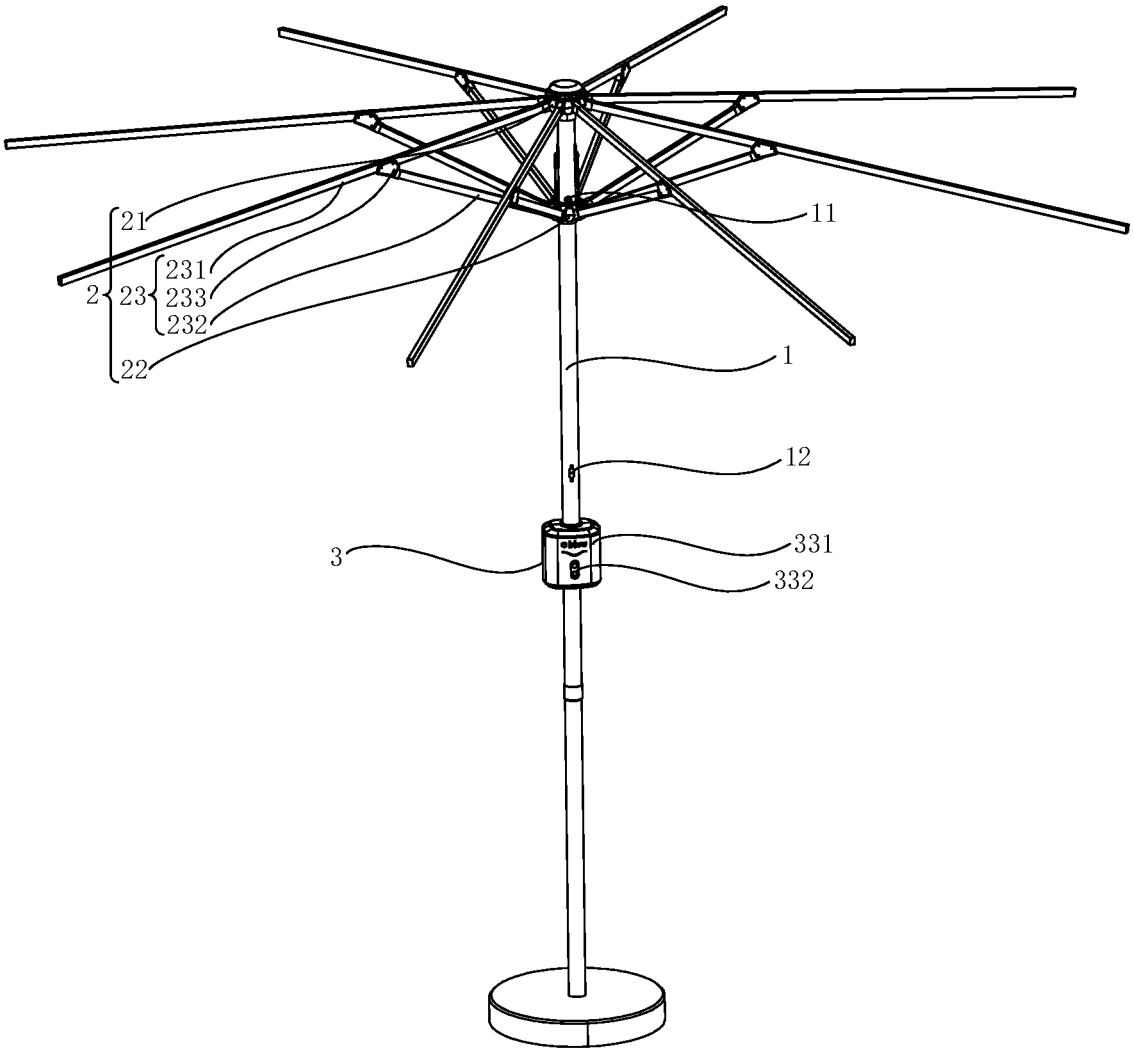
FIG. 1 shows a schematic diagram of the three-dimensional structure of the shading device in the embodiment of the present utility model.
Figure 2:
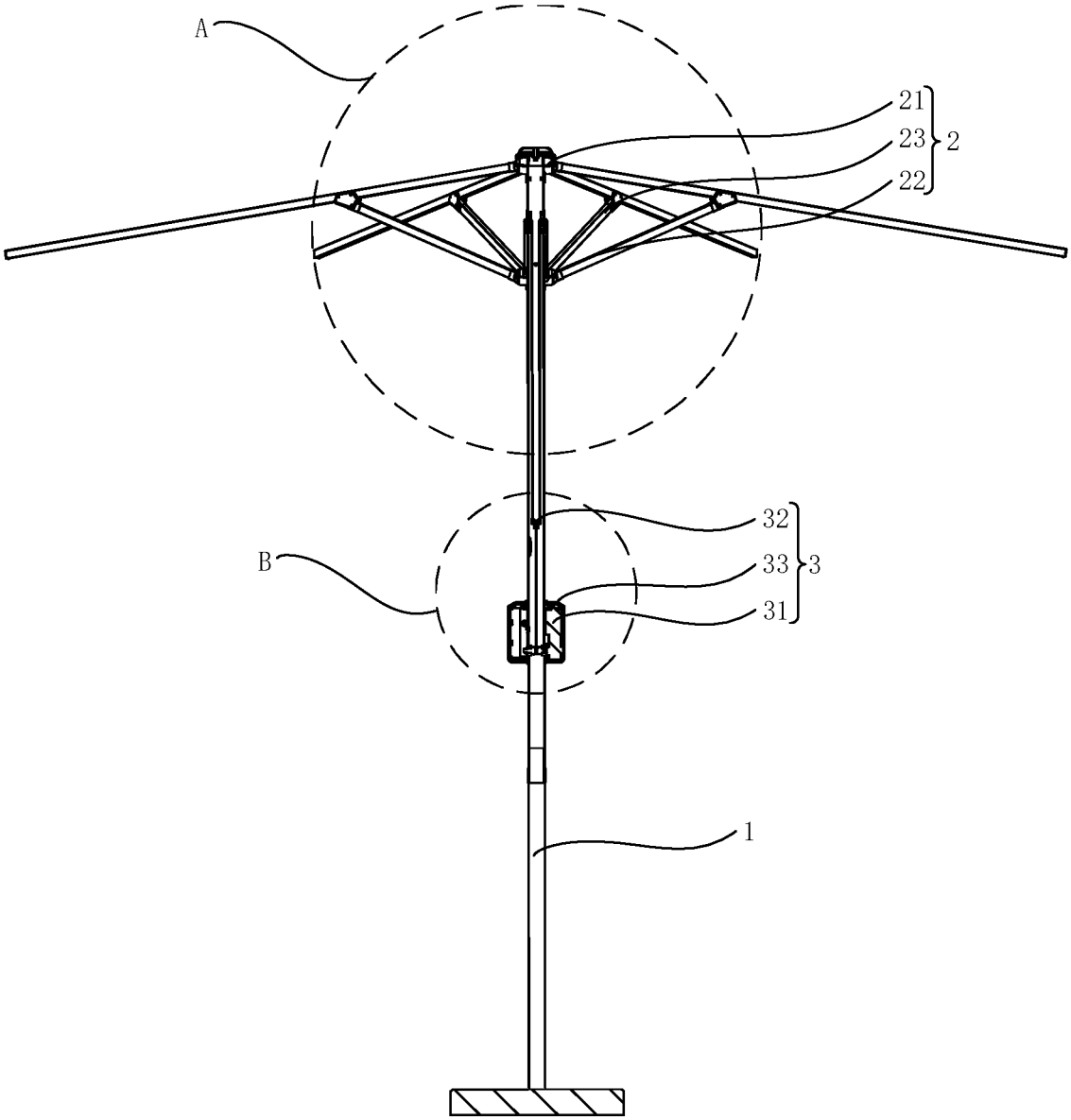
FIG. 2 shows a schematic diagram of the cross-sectional structure of the shading device in the embodiment of the present utility model.

Please refer to FIGS. 1 to 2 together. The embodiment of the present utility model provides a lifting device 3, which is used for a sunshade. The sunshade comprises a mounting frame 1, a sunshade cloth, a support mechanism 2, and a lifting device 3 set on the mounting frame 1. The support mechanism 2 comprises a fixed support member 21 set on the top of the mounting frame 1 and a movable support member 22 sliding on the mounting frame 1, and support components 23 that are respectively connected to fixed support member 21 and movable support member 22 and used for unfolding or closing the sunshade cloth. The sunshade is firmly supported on the ground through the mounting frame 1, the sunshade cloth is fixedly connected to the support components 23, and the support components 23 are respectively connected to the fixed support component 21 set at the top of the mounting frame 1 and the movable support component 22 sliding on the mounting frame 1, and the movable support member 22 is used to lift and move relative to the mounting frame 1, to realize the control of the unfolding or closing of the sunshade cloth; The lifting device 3 comprises a driving motor 31, a transmission mechanism 32 connected to the driving motor 31 and used to drive the lifting motion of the movable support member 22 relative to the mounting frame, and a control component 33 used to control the start and stop of the driving motor 31. The driving motor 31 and the movable support member 22 are connected through the transmission mechanism 32 to achieve the lifting motion of the movable support member 22 relative to the mounting frame 1 using the driving motor 31, thereby controlling the unfolding or closing of the sunshade cloth; Users can start and stop the driving motor 31 by operating the control component 33, so as to drive the movable support member 22 to lift and lower relative to the mounting frame 1, and thus control the unfolding or closing of the sunshade cloth. The use of driving method by the driving motor 31 instead of manual driving can save labor and effectively prevent users from being injured by the sunshade during use, providing convenience for users and improving their experience.

Figure 3:
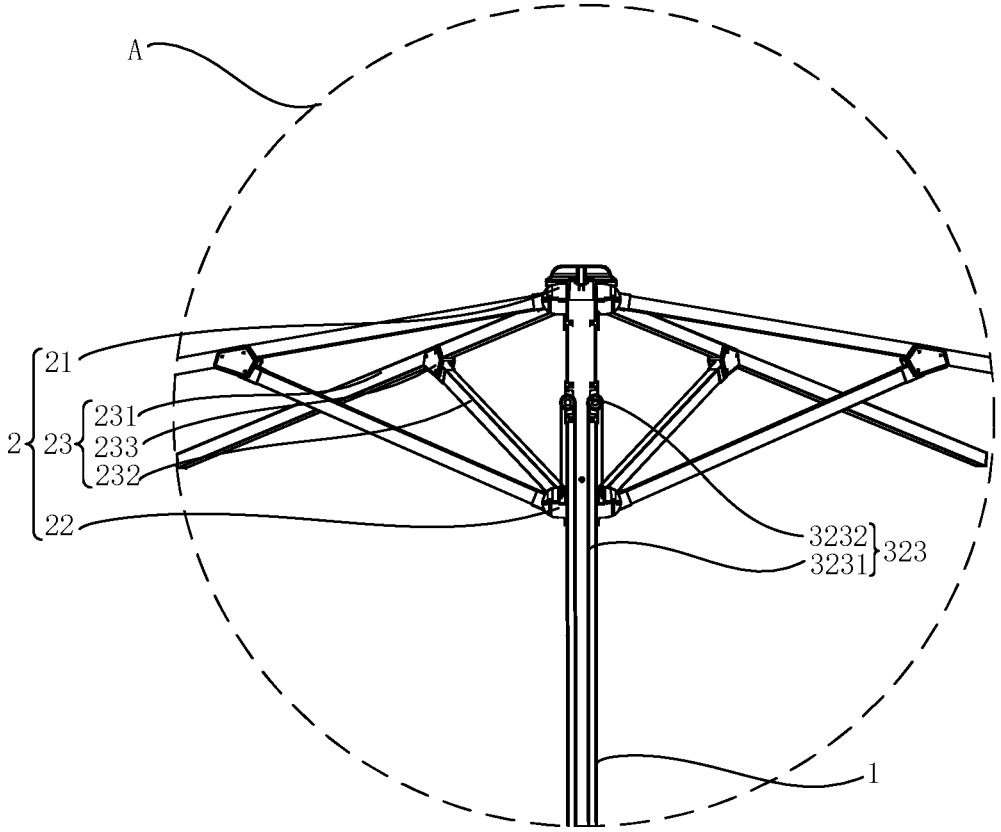
FIG. 3 shows a schematic diagram of the enlarged structure at position A in FIG. 2.
Figure 4:
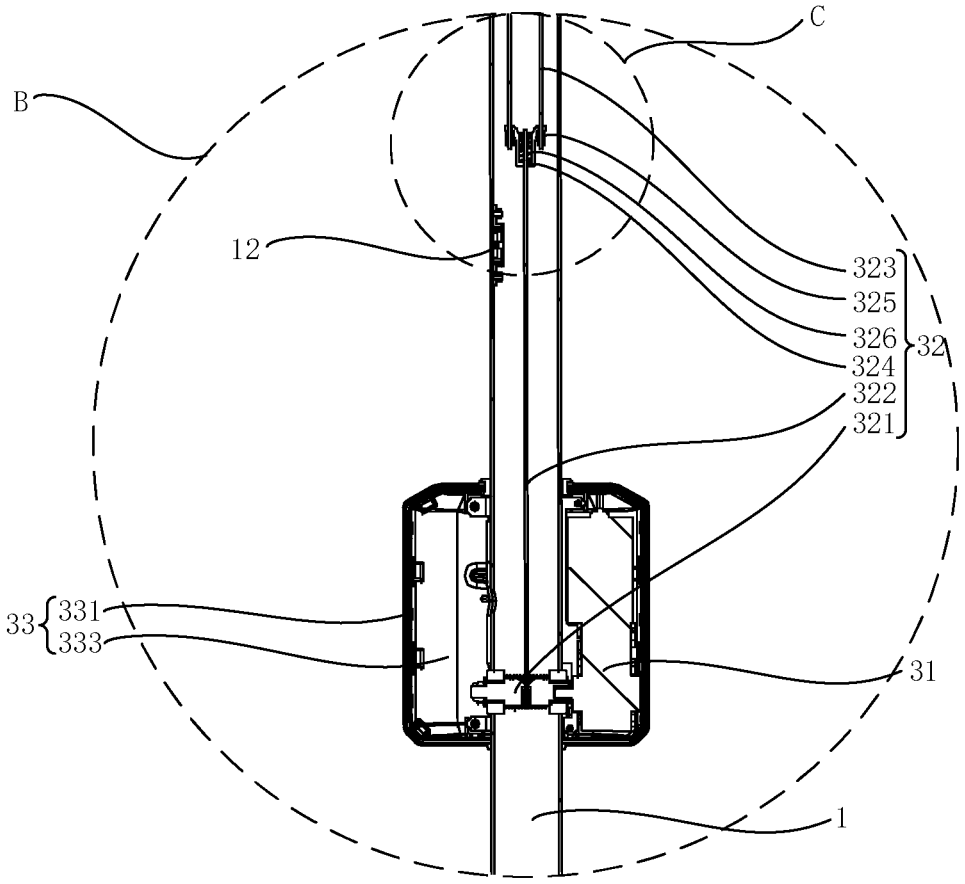
FIG. 4 shows a schematic diagram of the enlarged structure at position B in FIG. 2.
Figure 5:
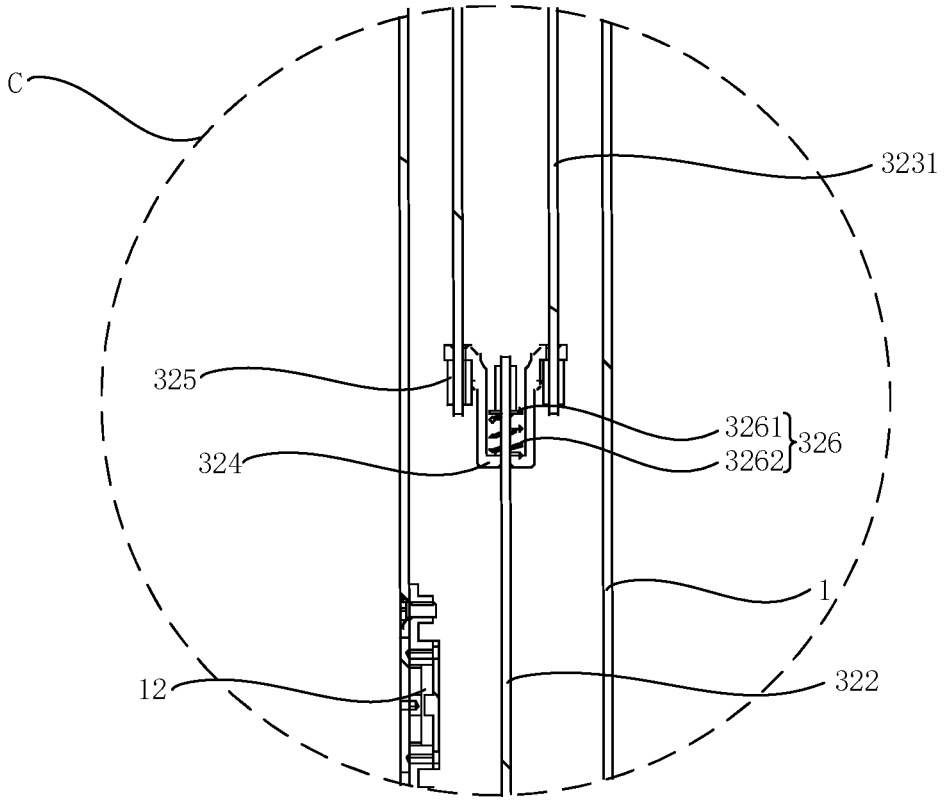
FIG. 5 shows a schematic diagram of the enlarged structure at position C in FIG. 4.

Please refer to FIGS. 3 to 5 together. As a specific implementation of the lifting device 3 for the sunshade in the embodiment of the present utility model, a fixed bracket for installing the lifting device 3 is set on the mounting bracket 1 of the sunshade, and the driving motor 31 and control component 33 are stably installed on the mounting bracket 1 using the fixed bracket; There is no restriction on the connection method between the fixed bracket and the mounting bracket 1 here; Optionally, the fixed bracket can be installed on the mounting bracket 1 using detachable or non detachable connections; Optionally, the fixed bracket can be installed on the mounting bracket 1 through threaded connection, which is convenient for assembly and disassembly, maintenance or replacement of accessories by operators, and helps to reduce the cost of using the sunshade.

Optionally, the transmission mechanism 32 of the lifting device 3 comprises a winding shaft 321 fixedly connected to the driving motor 31, a transmission component 323 for driving the lifting motion of the movable support member 22 relative to the mounting frame 1, and a main wire 322 wound on the winding shaft 321 and connected to the transmission component 323. The winding shaft 321 is rotatably set on the mounting frame 1 and fixedly connected to the output shaft of the driving motor 31. The driving motor 31 is used to drive the winding shaft 321 to rotate, loosen the main wire 322 wound on the winding shaft 321 or wind the main wire 322 on the winding shaft 321, thereby driving the transmission component 323 connected to the main wire 322. Then, the transmission component 323 is used to drive the movable support member 22 to move up and down relative to the mounting frame 1, to control the unfolding or closing of the sunshade cloth. The use of the driving motor 31 to drive the sunshade makes it more labor-saving for users.

Optionally, the transmission component 323 comprises a sub wire 3231 and a pulley 3232 located on the mounting frame 1 and above the movable support member 22. One end of the sub wire 3231 is connected to the main wire 322, while the other end bypasses the pulley 3232 and is connected to the movable support member 22. The main wire 322 and the movable support member 22 are connected through the sub wire 3231, and the pulley 3232 set above the movable support member 22 is used as the support point. When the driving motor 31 drives the winding shaft 321 to rotate and releases the main wire 322 wrapped on the winding shaft 321, the connection point between the main wire 322 and the sub wire 3231 moves upwards relative to the mounting frame 1. The sub wire 3231 moves relative to the pulley 3232 and causes the movable support member 22 connected to the other end of the sub wire 3231 to slide downwards relative to the mounting frame 1, thereby increasing the distance between the fixed support member 21 and the movable support member 22, and thus closing the sunshade cloth; When the driving motor 31 drives the winding shaft 321 to rotate and winds the main wire 322 onto the winding shaft 321, the connection point between the main wire 322 and the sub wire 3231 moves downwards relative to the mounting frame 1, and the sub wire 3231 moves relative to the pulley 3232, causing the movable support member 22 connected to the other end of the sub wire 3231 to slide upwards relative to the mounting frame 1, thereby reducing the distance between the fixed support member 21 and the movable support member 22, and thus unfolding the sunshade cloth.

Optionally, the number of transmission components 323 is multiple, and the multiple transmission components 323 are evenly distributed along the circumference of the movable support member 22, making the force on the movable support member 22 more uniform when the transmission component 323 pulls the movable support member 22. This ensures that the movable support member 22 moves up and down relative to the mounting frame 1 in a direction perpendicular to the horizontal plane, which is beneficial for reducing the friction force between the movable support member 22 and the outer wall of the mounting frame 1 during the sliding process, making the sunshade more stable during the unfolding or closing process, which is beneficial for improving the user experience. Optionally, the number of transmission components 323 is two, and the two transmission components 323 are symmetrically set on opposite sides of the mounting frame 1, to ensure that the movable support member 22 is evenly stressed during sliding relative to the mounting frame 1, while effectively controlling the production cost of the sunshade.

Optionally, the transmission mechanism 32 further comprises a splitter 324 for connecting the main wire 322 and the sub wire 3231. The splitter 324 is provided with a through hole for the main wire 322 and the sub wire 3231 to penetrate. The end of the main wire 322 and the end of the sub wire 3231 are both provided with a wiring sleeve 325 that is connected to the splitter 324. By setting a wiring sleeve 325 at the end of the main wire 322 and the end of the sub wire 3231, the main wire 322 and the sub wire 3231 are threaded through the through-hole on the splitter 324, and the wiring sleeve 325 is connected to the splitter 324, thus achieving the transmission of the power output from the driving motor 31 to multiple sub wires 3231 through the main wire 322. By using multiple sub wires 3231 to pull the movable support member 22 relative to the mounting frame 1, the sunshade cloth can be controlled to unfold or close.

Optionally, the transmission mechanism 32 further comprises a buffer component 326 arranged between the wiring sleeve 325 and the splitter 324. The buffer component 326 is used to buffer the impact force when the driving motor 31 starts, which can protect the driving motor 31 and the transmission mechanism 32, and is conducive to extending the service life of the sunshade; Optionally, the buffer component 326 comprises a support plate 3261 that is connected to the wiring sleeve 325 and an elastic member 3262 that is arranged between the splitter 324 and the support plate 3261. The support plate 3261 that is set on the splitter 324 is connected and fixed with the wiring sleeve 325 to prevent the main wire 322 and/or sub wire 3231 from detaching from the separator under external force, and the elastic member 3262 is used to buffer the impact force when the driving motor 31 starts, to protect the driving motor 31 and transmission mechanism 32. Optionally, the elastic element 3262 may be a spring or a shrapnel.

Please refer to FIGS. 1 and 5 together. In this embodiment, the lifting device 3 further comprises an upper limiter 11 and a lower limiter 12 set on the mounting frame 1 and electrically connected to the driving motor 31, which are used to limit the sliding range of the movable support member 22 on the mounting frame 1. When the user needs to use the sunshade, the control component 33 is used to start the lifting device 3. The driving motor 31 drives the movable support member 22 to slide relative to the mounting frame 1, and when the movable support member 22 reaches the upper limiter 11, the lifting device 3 stops operating. The driving motor 31 uses its own locking force to tighten the main wire 322, making the sunshade cloth in a unfolded state; When the user needs to close the sunshade, the control component 33 is used to start the lifting device 3, the driving motor 31 to release its locking force and drive the winding shaft 321 to rotate in the opposite direction. The main wire 322 is wound around the winding shaft 321, and the movable support member 22 slides downwards relative to the mounting frame 1 under the gravity of the sunshade cloth and support mechanism 2, as well as the driving effect of the driving motor 31. When the movable support member 22 reaches the lower limiter 12, the lifting device 3 stops operating, and the driving motor 31 uses its own locking force to tighten the main wire 322, causing the sunshade cloth to be in a closed state. The specific structures of upper limiter 11 and lower limiter 12 on mounting bracket 1 are not limited here. Optionally, the upper limiter 11 and/or lower limiter 12 are position sensors. When the movable support member 22 slides to the position of the upper limiter 11 or lower limiter 12 relative to the mounting frame 1, the driving motor 31 stops operating and uses its own locking force to tighten the main wire 322, keeping the sunshade cloth in an unfolded or closed state. Optionally, the upper limiter 11 and/or the lower limiter 12 are limit protrusions protruding from the mounting bracket 1 and used to limit the movement of the movable support member 22. An overload monitoring module is installed on the driving motor 31. When the movable support member 22 slides relative to the mounting bracket 1 to come into contact with the upper limiter 11 or the lower limiter 12, the movable support member 22 stops sliding under the limit action of the upper limiter 11 or the lower limiter 12, resulting in an increase in the resistance of the driving motor 31 to drive the winding shaft 321. At this point, the overload monitoring module of driving motor 31 detects that the load of driving motor 31 exceeds the limit and controls it to stop operating. At the same time, it uses its own locking force to tighten the main wire 322, keeping the sunshade cloth in an unfolded or closed state. It is characterized by simple structure and easy production.

Please refer further to FIGS. 1 and 4. In this embodiment, the control component 33 of the lifting device 3 comprises a control housing 331, a battery 333 detachably connected to the control housing 331, and a function key 332 electrically connected to the driving motor 31, which is set on the control housing 331. The control housing 331 is firmly installed on the mounting frame 1 through a fixed bracket set on the mounting frame 1, and a mounting portion for detachably connecting the battery 333 is set on the control housing 331, By installing a large capacity battery 333 on the mounting portion of the control housing 331, the required electrical energy is provided for the operation of the lifting device 3. While meeting the user's usage needs, the charging frequency is minimized as much as possible. In special circumstances, the battery 333 can be removed to charge the user's mobile terminal, which is beneficial for improving the user experience. Optionally, the function key 332 electrically connected to the driving motor 31 on the control housing 331 comprises an up key for indicating the upward sliding of the movable support member 22 relative to the mounting frame 1 and a down key for indicating the downward sliding of the movable support member 22 relative to the mounting frame 1. The user only needs to press the function key 332 to achieve the lifting motion of the movable support member 22 relative to the mounting frame 1, thereby controlling the unfolding or closing of the sunshade cloth. The use of driving method by the driving motor 31 instead of manual driving can save labor and effectively prevent users from being injured by the sunshade during use, providing convenience for users and improving their experience. Optionally, a signal receiving terminal is set on the control panel inside the control housing 331. Users can send a signal to the signal receiving terminal through the remote control to remotely start the lifting device 3, and drive the movable support member 22 to move relative to the mounting frame 1, thereby controlling the unfolding or closing of the sunshade cloth. It is characterized by simple structure, labor-saving and convenient operation, providing convenience for users and improving user experience.

Please refer to FIGS. 1 to 3 together. The embodiment of the present utility model provides a shading device, which comprises a mounting frame 1, a sunshade cloth, a support mechanism 2, and the lifting device 3 set on the mounting frame 1. The support mechanism 2 comprises a fixed support member 21 set on the top of the mounting frame 1 and a movable support member 22 sliding on the mounting frame 1, and the support components 23 that are respectively connected to fixed support member 21 and movable support member 22 and used for unfolding or closing the sunshade cloth. The shading device is firmly supported on the ground through the mounting frame 1, the sunshade cloth is fixedly connected to the support components 23, and the support components 23 are respectively connected to the fixed support component 21 set at the top of the mounting frame 1 and the movable support component 22 sliding on the mounting frame 1, and the movable support member 22 is used to lift and move relative to the mounting frame 1, to realize the control of the unfolding or closing of the sunshade cloth; The lifting device 3 comprises a driving motor 31, a transmission mechanism 32 connected to the driving motor 31 and used to drive the lifting motion of the movable support member 22 relative to the mounting frame, and a control component 33 used to control the start and stop of the driving motor 31. The driving motor 31 and the movable support member 22 are connected through the transmission mechanism 32 to achieve the lifting motion of the movable support member 22 relative to the mounting frame 1 using the driving motor 31, thereby controlling the unfolding or closing of the sunshade cloth; Users can start and stop the driving motor 31 by operating the control component 33, so as to drive the movable support member 22 to lift and lower relative to the mounting frame 1, and thus control the unfolding or closing of the sunshade cloth. The use of driving method by the driving motor 31 instead of manual driving can save labor and effectively prevent users from being injured by the sunshade umbrella during use, providing convenience for users and improving their experience.

Optionally, the support component 23 of the support mechanism 2 comprises a main support rod 231 fixedly connected to the sunshade cloth and the fixed support member 21, an auxiliary support rod 232 fixedly connected to the movable support member 22, and a connecting bracket 233. The connecting bracket 233 is arranged at the end of the auxiliary support rod 232 away from the movable support member 22, and the connecting bracket 233 is slidably connected to the main support rod 231. When the movable support member 22 is driven by the lifting device 3 to move up and down relative to the mounting frame 1, the auxiliary support rod 232 fixedly connected to the movable support member 22 also moves up and down relative to the mounting frame 1, so that the connecting bracket 233 set at the end of the auxiliary support rod 232 away from the movable support member 22 slides relative to the main support rod 231, and the distance between the movable support member 22 and the fixed support member 21 changes accordingly, thereby achieving the control of the unfolding or closing of the sunshade cloth.

The above is only a preferred embodiment of this embodiment and is not intended to limit this embodiment. Any modifications, equivalent replacements and improvements made within the spirit and principles of this embodiment shall be included within the scope of protection of this embodiment.

What is claimed is:

1. A lifting device for a sunshade, characterized in that the sunshade comprises a mounting frame, a sunshade cloth, a support mechanism and a lifting device set on the mounting frame, wherein the support mechanism comprises a fixed support member arranged at the top of the mounting frame, and a movable support member sliding on the mounting frame, and a support component connected to the fixed support member and the movable support member respectively and used for unfolding or closing the sunshade cloth, the lifting device comprises a driving motor, a transmission mechanism connected to the driving motor and used to drive the lifting motion of the movable support member relative to the mounting bracket, and a control component used to control the start and stop of the driving motor;

wherein the transmission mechanism comprises a winding shaft fixedly connected to the driving motor, a transmission component for driving the lifting motion of the movable support member relative to the mounting bracket, and a main wire wound on the winding shaft for connecting the transmission component;

wherein the transmission component comprises a sub wire and a pulley set on the mounting bracket and above the movable support member, one end of the sub wire is connected to the main wire, and the other end bypasses the pulley and is connected to the movable support member;

wherein the number of transmission components is multiple, and the multiple transmission components are uniformly distributed along the circumference of the movable support member, and the transmission mechanism further comprises a splitter for connecting the main wire and the sub wire, and the splitter is provided with a through hole for the main wire and the sub wire to penetrate, the end of the main wire and the end of the sub wire are both equipped with wiring sleeves that are connected to the splitter; and wherein the transmission mechanism further comprises a buffer component arranged between the wiring sleeve and the splitter, and the buffer component comprises a support plate that is connected to the wiring sleeve and an elastic element arranged between the splitter and the support plate.

2. A lifting device for a sunshade in claim 1, characterized in that the lifting device further comprises an upper limiter and a lower limiter set on the mounting bracket and electrically connected to the driving motor, used to limit the sliding range of the movable support member on the mounting bracket.

3. The lifting device for a sunshade of claim 2, characterized in that the upper limiter and/or the lower limiter are limit protrusions on the mounting bracket and used to limit the movement of the movable support member, and the driving motor is equipped with an overload monitoring module.

4. The lifting device for a sunshade of claim 2, characterized in that the upper limiter and/or lower limiter are position sensors.

5. The lifting device for a sunshade in claim 1, characterized in that the control component comprises a control housing, a battery detachably connected to the control housing, and a function key set on the control housing and electrically connected to the driving motor.

6. A shading device, characterized in that it comprises a mounting frame, a sunshade cloth, and the lifting device according to claim 1 set on the mounting frame.

7. The shading device of claim 6, characterized in that the supporting component comprises a main support rod fixedly connected to the sunshade cloth, an auxiliary support rod fixedly connected to the movable support member, and a connecting bracket which is arranged at the end of the auxiliary support rod far from the movable support member, and the connecting bracket is slidably connected to the main support rod.

* * * * *